US008027605B2

(12) United States Patent
Takeuchi et al.

(10) Patent No.: US 8,027,605 B2
(45) Date of Patent: Sep. 27, 2011

(54) IMAGE FORMING APPARATUS AND IMAGE DENSITY CONTROL METHOD

(75) Inventors: Nobutaka Takeuchi, Yokohama (JP); Shin Hasegawa, Zama (JP); Hitoshi Ishibashi, Kamakura (JP); Shuji Hirai, Tokyo (JP); Kohta Fujimori, Yokohama (JP); Kayoko Tanaka, Machida (JP); Yushi Hirayama, Sagamihara (JP); Akira Yoshida, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 211 days.

(21) Appl. No.: 12/246,601

(22) Filed: Oct. 7, 2008

(65) Prior Publication Data

US 2009/0110413 A1 Apr. 30, 2009

(30) Foreign Application Priority Data

Oct. 24, 2007 (JP) ..... 2007-276563

(51) Int. Cl.
*G03G 15/10* (2006.01)
*G03G 15/08* (2006.01)

(52) U.S. Cl. ..... 399/59; 399/27; 399/254

(58) Field of Classification Search ..... 399/27, 399/29, 30, 58, 59, 62, 254
See application file for complete search history.

(56) References Cited

U.S. PATENT DOCUMENTS

| | | | | |
|---|---|---|---|---|
| 5,182,600 | A | 1/1993 | Hasegawa et al. | |
| 5,198,861 | A | 3/1993 | Hasegawa et al. | |
| 5,327,196 | A | 7/1994 | Kato et al. | |
| 5,387,965 | A | 2/1995 | Hasegawa et al. | |
| 5,630,195 | A | 5/1997 | Sawayama et al. | |
| 5,761,570 | A | 6/1998 | Sawayama et al. | |
| 5,857,131 | A | 1/1999 | Hasegawa | |
| 5,860,038 | A | 1/1999 | Kato et al. | |
| 6,055,386 | A | 4/2000 | Kato et al. | |
| 6,160,569 | A | 12/2000 | Fujimori et al. | |
| 6,496,677 | B2 | 12/2002 | Fujimori | |
| 6,975,338 | B2 | 12/2005 | Hirai et al. | |
| 7,151,901 | B2 | 12/2006 | Hirai | |
| 7,193,642 | B2 | 3/2007 | Hirai et al. | |
| 7,228,081 | B2 | 6/2007 | Hasegawa et al. | |
| 7,251,420 | B2 | 7/2007 | Fujimori et al. | |
| 2004/0251435 | A1 | 12/2004 | Sawayama et al. | |
| 2007/0122168 | A1 * | 5/2007 | Tanaka et al. | 399/27 |

FOREIGN PATENT DOCUMENTS

| | | |
|---|---|---|
| JP | 57-136667 | 8/1982 |
| JP | 2-34877 | 2/1990 |

* cited by examiner

*Primary Examiner* — Sandra Brase
(74) *Attorney, Agent, or Firm* — Oblon, Spivak, McClelland, Maier & Neustadt, L.L.P.

(57) ABSTRACT

An image forming apparatus and an image density control method for controlling image density in the image forming apparatus, involving adjusting a toner concentration control reference value in accordance with an amount of the toner replaced in a developing device so as to adjust the image density to maintain a consistent developability and changing image forming intervals in accordance with an amount of the toner replaced in the developing device during continuous printing operation.

8 Claims, 8 Drawing Sheets

IMAGE FORMING APPARATUS AND IMAGE DENSITY CONTROL METHOD

CROSS-REFERENCE TO RELATED APPLICATIONS

This patent application is based on and claims priority pursuant to 35 U.S.C. §119 from Japanese Patent Application No. 2007-276563 filed on Oct. 24, 2007 in the Japan Patent Office, the entire contents of which are hereby incorporated herein by reference.

BACKGROUND OF THE INVENTION

1. Field of the Invention

Exemplary aspects of the present invention generally relate to an image forming apparatus including printers, copiers, and facsimiles, and an image density control method employed therein.

2. Description of the Background Art

In recent years, in addition to high imaging quality, durability and stability are expected of image forming apparatuses, such as printers, copiers, facsimile machines, and the like. In other words, it is necessary to minimize fluctuation in imaging quality and provide consistently stable imaging regardless of changes in operating environment or in operating conditions, such as continuous printing and intermittent printing.

Conventionally, a two-component developing method using a two-component developer composed essentially of a non-magnetic toner and a magnetic carrier (hereinafter referred simply as a developer) is widely known.

In the two-component developing method, the developer is borne on a developer bearing member (hereinafter referred to as a developing sleeve) including magnetic poles therein. The magnetic poles in the developer sleeve form a magnetic brush thereon. When a developing bias is supplied to the developing sleeve at a position facing a photoreceptor serving as a latent image carrier, a latent image on the photoreceptor surface is developed.

The two-component developing method is widely used because colorization is relatively easy with this method. In the two-component developing method, the developer is transported to a developing region by the rotation of the developing sleeve. When the developer is transported to the developing region, a number of magnetic carrier particles with toner particles in the developer are concentrated along magnetic lines of the magnetic poles, thereby forming the magnetic brush.

More than in a single-component developing method, in the two-component developing method it is important to control accurately a weight ratio of a toner and a carrier, that is, a toner concentration, in order to enhance stability. For example, when the toner concentration is too high, contamination of a background in an image and/or reduction in the resolution of fine images may occur.

By contrast, when the toner concentration is too low, the toner concentration of a solid portion of an image may decrease or the carrier may stick inadvertently. For this reason, it is necessary to regulate an amount of toner supply so that the concentration of toner in the developer is properly maintained.

One common method of regulating the toner concentration involves, for example, comparing an output value Vt of a toner concentration detector (such as a permeability sensor) to a toner concentration control reference value Vtref. In accordance with a difference between Vt and Vtref obtained, the amount of toner to be supplied is calculated, thereby enabling a toner supply device to supply the toner to a developing device in the proper amount.

The above-described method using the permeability sensor is one common method of detecting toner concentration. In this method, a change in the permeability of the developer caused by a change in the toner concentration represents a change in the toner concentration.

Another known method for detecting the toner concentration uses an optical sensor. In this method, a reference pattern is created on the image bearing member or an intermediate transfer belt and scanned with LED light. Reflected light (specular light or diffuse reflection) from the reference pattern is detected by an optical sensor such as a photodiode and a phototransistor. Based on a result provided by the optical sensor, the toner concentration or an amount of toner adhered to the reference pattern can be detected.

In a variation of the above-described approach, a reference pattern (a reference toner pattern) is created between recording sheets. In other words, the reference pattern is created at certain intervals (time or distance) between a previous imaging operation and a subsequent imaging operation. The photosensor detects reflected light from the reference toner pattern, thereby controlling the toner concentration control reference value Vtref.

Thus, for example, in a method for controlling image density disclosed in Japanese Patent Unexamined Application Publications Nos. Sho57-136667 and Hei02-34877, a toner pattern is formed in a non-image portion of an image and a detector detects a pattern density of the toner pattern. In accordance with the density of the toner pattern, a target value for the toner concentration control is adjusted to maintain image density.

However, a drawback of forming the toner pattern at the intervals between the previous and the subsequent transfer sheets is unnecessary toner consumption. Consequently, there is strong market demand for reducing the amount of toner consumed to produce the toner pattern. For this reason, when correction of the toner concentration is performed by forming the reference toner pattern between transfer sheets, either the frequency of formation of the toner patterns tends to be reduced or no reference toner pattern is formed at all.

Further, in a case in which the toner pattern is formed on the intermediate transfer belt and the secondary transfer roller is not separated from the intermediate transfer belt for each image-forming operation, a cleaning device is needed to remove the toner from the reference pattern that adheres to the secondary transfer roller.

By contrast, when the secondary transfer roller is separated from the intermediate transfer belt every time an image-forming operation is finished or after a certain number of image-forming operations, no cleaning device may be needed. However, in this case, mechanical durability of the structure is required in order to accommodate repeated separation of the secondary transfer roller from the intermediate transfer belt. In addition, when the secondary transfer roller separates from and contacts the intermediate transfer belt it generates vibrations that may show up as banding in an image.

As described above, it is desirable to reduce the frequency of formation of the toner patterns, for reasons of both imaging quality and cost reduction.

Accordingly, Japanese Patent No. 3410198 discloses ways in which the toner concentration may be reliably maintained. According to Japanese Patent No. 3410198, when the amount of toner supplied is controlled using the toner concentration sensor, fluctuation in the output of the toner concentration sensor caused by fluctuation in fluidity of the developer due to the duration of agitation is corrected.

However, even if a certain toner concentration is maintained, when developability of the developer is not stable, that is, when an amount of charge on the toner is not consistent, it is difficult to maintain the image density reliably solely by maintaining consistent toner concentration sensor output.

As a result, recently there have appeared image forming apparatuses that use methods for preventing the developing device from stressing the toner, such as adding additives such as silica ($SiO_2$), titanium oxide ($TiO_2$), or the like to the surface of the toner in order to enhance dispersion of the toner in image forming apparatuses using a two-component color developer.

However, such additives are susceptible to degradation due to mechanical stress or heat. Consequently, when being agitated in the developing device, such additives may be absorbed into the toner or separated inadvertently from the toner surface, causing fluctuation in fluidity and/or charging characteristics of the developer. Further, physical adhesion properties of the toner and the carrier may also change.

Moreover, when the stress generated by the developing device is reduced, the toner charging ability, that is, the ability of the developing device to charge the toner, may deteriorate for the following reason.

When an image having a relatively low ratio of an image area to the total area of the image is output, that is, when a relatively small amount of the toner is replaced per unit of time or per unit of sheets, the developability is maintained consistently. In other words, a slope of a graph, plotting amount of the toner developed against developing bias constant.

By contrast, when an image having a relatively large ratio of the image area to the total area of the image is output, that is, when a relatively large amount of the toner is replaced per unit of time or per unit of sheets, the developability may increase.

In other words, the developability changes depending on the amount of the toner replaced in the developer. This means that the developability changes even if the toner concentration does not change. Consequently, the toner concentration control reference value needs to be adjusted in order to maintain consistent developability over time.

However, there is a problem in that, when the image area ratio is relatively high, the toner concentration may not be maintained reliably simply by adjusting the toner concentration control reference value.

In view of the above, conventionally, electric potential is regulated during printing of an image having a high image area ratio so as to adjust image forming bias for forming the image and thus stabilize the image density.

According to this related-art approach, a print job is temporarily halted and the apparatus is put into an adjustment mode. Reference toner patterns of approximately 10 gradations are formed on the intermediate transfer belt, and the densities thereof are detected by the photosensor. According to a formula that relates the developing potential and the amount of the toner adhered, an appropriate developing bias can be obtained. Subsequently, the apparatus is returned to a print mode and printing is resumed.

However, with this configuration, the designated reference pattern for adjustment of the potential needs to be formed and detected, thereby generating more downtime for the image forming apparatus.

SUMMARY OF THE INVENTION

Exemplary embodiments of the present invention provide an image forming apparatus and an image density control method for controlling image density in an image forming apparatus.

According to one preferred embodiment, the image forming apparatus includes an image bearing member, a developing device, a toner supply device, a toner concentration controller, and a transfer device. The image bearing member is configured to bear an electrostatic latent image on a surface thereof. The developing device is configured to develop the electrostatic latent image formed on the image bearing member using a two-component developer including a toner and a carrier to form a toner image. The toner supply device is configured to supply the toner to the developing device. The toner concentration controller is configured to maintain a toner concentration in the developing device at a certain density. The transfer device is configured to transfer the toner image on the image bearing member.

According to another preferred embodiment, the image density control method includes adjusting a toner concentration control reference value in accordance with an amount of the toner replaced in the developing device so as to adjust the image density to maintain a consistent developability and changing image forming intervals in accordance with an amount of the toner replaced in the developing device during continuous printing operation.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
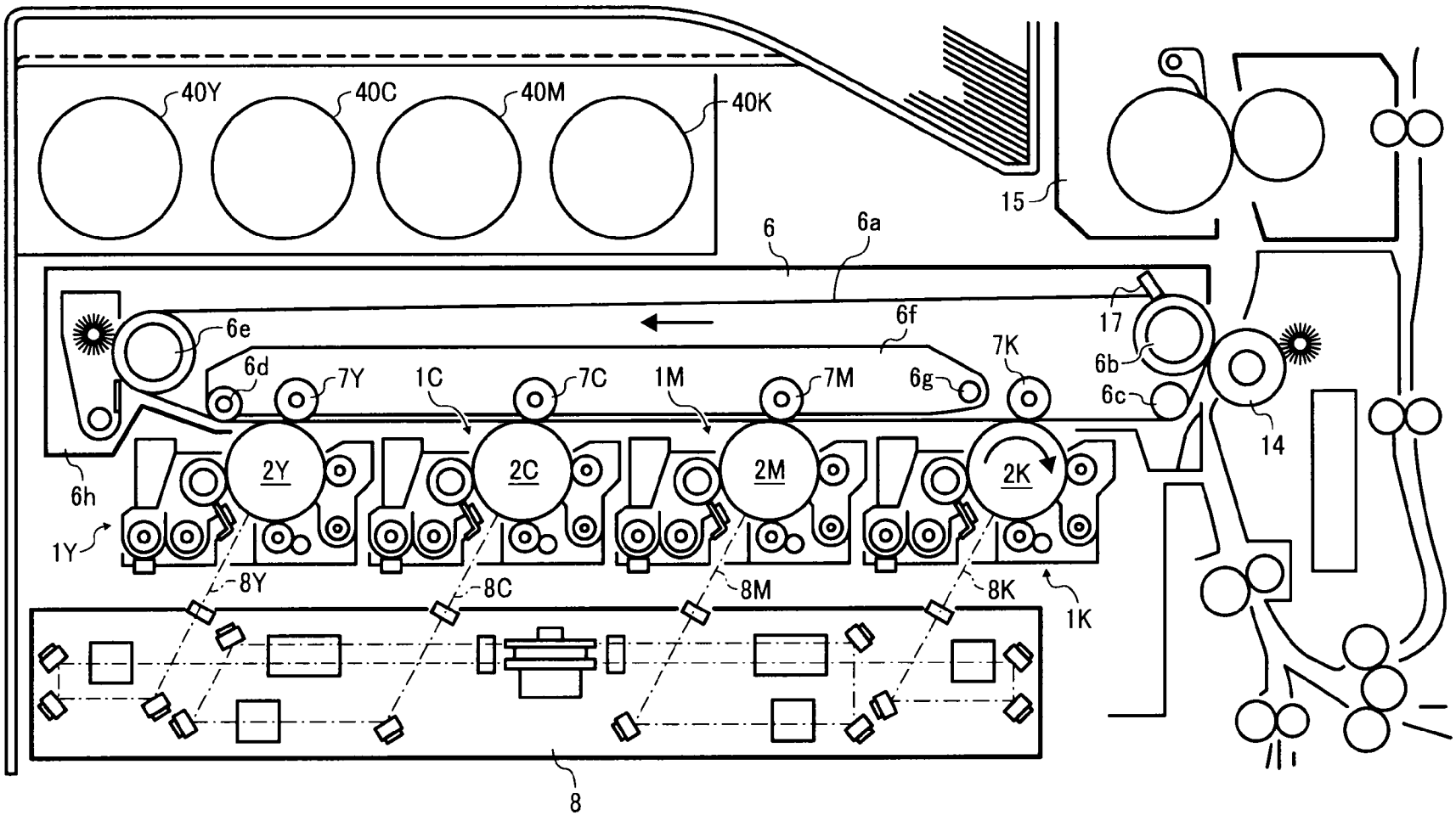
FIG. 1 is a schematic diagram illustrating a full-color printer as an example of an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Exemplary embodiments of the present invention are now described below with reference to the accompanying drawings.

In a later-described comparative example, exemplary embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, a full-color printer as one example of an image forming apparatus according to an exemplary embodiment of the present invention is described with reference to FIG. 1.

FIG. 1 is a schematic diagram illustrating a full-color printer (hereinafter referred to as an image forming apparatus) as one example of an image forming apparatus according to the exemplary embodiment of the present invention.

The image forming apparatus includes four drum-type photoreceptors 2Y, 2M, 2C, and 2K, each of which serves as a latent image carrier for forming color images of yellow (Y), cyan (C), magenta (M), and black (K), respectively.

It is to be noted that reference characters Y, C, M, and K denote the colors yellow, cyan, magenta, and black, respectively. To simplify the description, the reference characters Y, M, C, and K indicating colors are omitted herein unless otherwise specified.

The photoreceptors 2Y, 2M, 2C, and 2K are rotated by a drive source, not shown, in a counterclockwise direction when the image forming apparatus is in operation.

Components necessary for electrophotographic image forming operation, for example, developing devices 5 (see FIG. 2) and four image forming units 1Y, 1C, 1M, and 1K are provided around the photoreceptors 2Y, 2M, 2C, and 2K. The image forming units 1Y, 1C, 1M, and 1K all have the same configuration, differing only in the color of toner employed.

Figure 2:
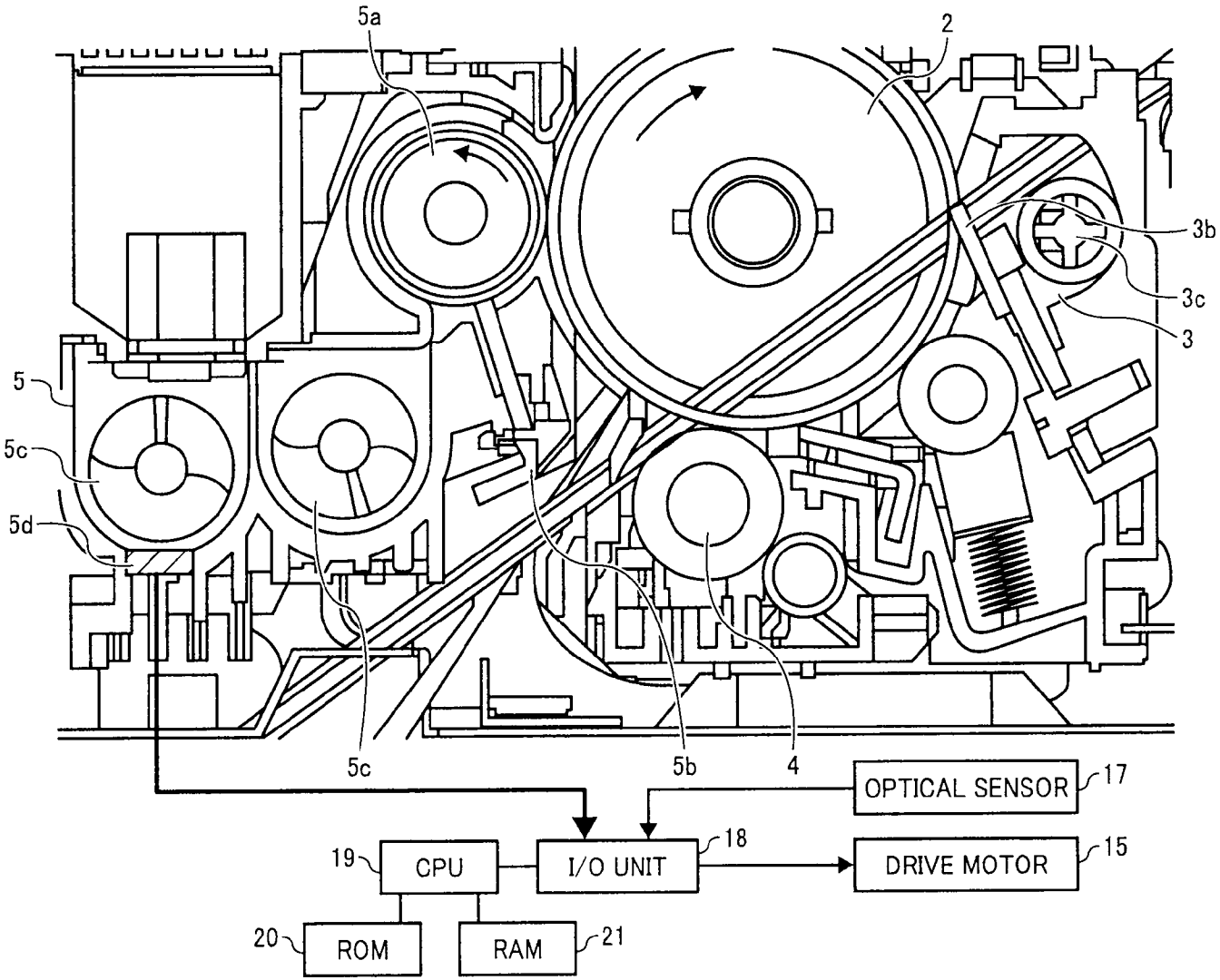
FIG. 2 is an enlarged view illustrating one image forming unit as a representative example of multiple image forming units in the image forming apparatus of FIG. 1 according to an exemplary embodiment of the present invention.

Referring now to FIG. 2, there is provided a partially enlarged view illustrating one of the image forming units 1Y, 1C, 1M, and 1K as a representative example thereof. In accordance with the electrophotographic process, the image forming unit 1 includes, surrounding the photoreceptor 2 clockwise from the bottom, a charging device 4 including a charging roller, a developing device 5 including a developing roller 5*a*, a developing blade 5*b*, a conveyance screw 5*c* and so forth, and a cleaning device 3 including a cleaning brush 3*a*, or a cleaning blade 3*b*, a recovery screw 3*c*, and so forth.

The photoreceptor 2 is formed of an aluminum cylinder having a diameter, for example, of approximately 30 mm to 120 mm. The surface of the aluminum cylinder includes a layer of an organic semiconductor including photoconductive material. Alternatively, the photoreceptor 2 may be a belt type.

As illustrated in FIG. 1, an exposure device 8 is provided substantially below the photoreceptors 2Y, 2C, 2M, and 2K, respectively. The exposure device 8 scans the surface of the respective photoreceptor 2, which has been uniformly charged by the charging device 4, with laser beams 8Y, 8C, 8M, and 8K in accordance with image data for each color.

A long narrow gap is formed in a direction of a rotation axis of the photoreceptor 2 between each of the charging devices 4 and each of the development devices 5, such that the laser beam emitted from the exposure device 8 strikes the photoreceptor 2.

The exposure device 8 employs a laser scan method using a light source, a polygon mirror, and so forth. Laser beams 8Y, 8C, 8M, and 8K, modulated in accordance with image data, are emitted from four laser diodes, not shown. The exposure device 8 includes a housing formed of metal or resin that contains optical parts and parts for control. The exposure device 8 also includes a translucent dustproof member provided at a laser beam window in an upper surface of the housing.

According to the exemplary embodiment, the exposure device 8 includes a single housing. Alternatively, however, a plurality of exposure devices may be provided independently for each of the image forming units. In another alternative embodiment, besides the exposure device including the light source that emits the laser beams, an exposure device including a known LED array and an imaging device may be employed.

An electrostatic latent image of each color is formed on the surface of the photoreceptor 2 of the respective color using the laser beam. Each of the electrostatic latent images is then developed by each of the developing devices 5 using the respective color of toner, thereby forming a toner image, that is, a visible image.

As will be later described, the developing device 5 employs the two-component developer consisting essentially of toner and carrier and hereinafter referred to as a developer. The toners of yellow (Y), cyan (c), magenta (M), and black (K) are consumed in the developing units 5Y, 5C, 5M, and 5K, and detected by a later-described toner detector so that each color of toner is supplied from toner cartridges 40Y, 40C, 40M, and 40K to the developing devices 5Y, 5C, 5M, and 5K, respectively, by a toner supply device, not shown. The toner cartridges 40Y, 40C, 40M, and 40K are provided at substantially the upper portion of the image forming apparatus.

An intermediate transfer unit 6 is provided substantially above the photoreceptors 2Y, 2C, 2M, and 2K. The intermediate transfer unit 6 includes an intermediate transfer belt 6*a* serving as an image bearing member and a plurality of rollers 6*b*, 6*c*, 6*d*, and 6*e*. The intermediate transfer belt 6*a* is wound around and stretched between the rollers 6*b*, 6*c*, 6*d*, and 6*e*. As illustrated in FIG. 1, the intermediate transfer belt 6*a* travels in a direction indicated by an arrow when the roller 6*b* rotates.

The intermediate transfer belt 6*a* is an endless belt, and provided such that a portion of each of the photoreceptors 2 after development contacts the intermediate transfer belt 6*a*.

Primary transfer rollers 7Y, 7C, 7M, and 7K are provided in an inner loop of the intermediate transfer belt 6*a*, facing the photoreceptors 2Y, 2C, 2M and 2K.

A cleaning device 6*h* is provided at the outer loop of the intermediate transfer belt 6*a*, facing the roller 6*e*. The cleaning device 6*h* is configured to remove foreign substances such as residual toner, paper dust, and the like remaining on the surface of the intermediate transfer belt 6*a*.

The roller 6*e* across from the cleaning device 6*h* includes a tension mechanism configured to exert tension on the intermediate transfer belt 6*a*. The roller 6*e* is configured to move so as to secure an appropriate belt tension consistently. Further, the cleaning device 6*h* facing the roller 6*e* may move in conjunction with the movement of the roller 6*e*.

As illustrated in FIG. 1, an optical sensor 17 is provided in the vicinity of the intermediate transfer belt 6*a*. The optical sensor 17 is configured to detect a toner concentration from a reference pattern for measurement of the toner concentration formed on the intermediate transfer belt 6*a*.

The intermediate transfer belt 6*a* is a belt formed of a resin film or rubber having a thickness, for example, of between 50 μm and 600 μm. The intermediate transfer belt 6*a* has a resistance value that causes the visible toner image borne on each of the photoreceptors 2 to be transferred electrostatically onto the intermediate transfer belt 6*a* when a bias is applied to the primary transfer rollers 7.

It is to be noted that components associated with the intermediate transfer belt 6*a* are installed in the intermediate transfer unit 6, which is detachably mountable relative to the image forming apparatus.

A description will now be provided of the image forming unit 1Y for yellow during printing. It is to be noted that each of the image forming units 1Y, 1C, 1M, and 1K has the same configuration as all the others, differing only in the color of toner employed. Thus, the description is provided of the image forming unit 1Y as a representative example of the image forming unit 1.

The charging roller 4*a*Y evenly charges the surface of the photoreceptor 2Y. The laser beam 8Y corresponding to image data, emitted from the laser diode of the exposure device 8, illuminates the charged surface of the photoreceptor 2Y, thereby forming an electrostatic latent image thereon.

Subsequently, the developing roller 5*a*Y supplies the developer including the toner to the electrostatic latent image so as to develop the electrostatic latent image. Accordingly, a visible image, also known as a toner image, is formed.

Then, the visible image is primarily transferred by the intermediate transfer roller 7Y onto the intermediate transfer belt 6*a* which travels in synchronization with the photoreceptor 2Y.

Such latent image forming operation, development, and primary transfer operation are also performed with respect to the photoreceptors 2C, 2M, and 2K at appropriate timing. Accordingly, the toner images of yellow, cyan, magenta, and black are overlappingly transferred onto the intermediate transfer belt 6*a*, forming a four-color composite toner image. The four-color composite toner image is borne on the intermediate transfer belt 6*a* and travels along a direction of arrow in FIG. 1.

In the meantime, the cleaning device 3 removes foreign substances such as the toner remaining on the surface of the photoreceptor 2 after development from the surface of the photoreceptor 2.

The four-color composite toner image formed on the intermediate transfer belt 6*a* is transferred by a secondary transfer roller 14 onto a recording medium, such as a paper sheet or the like transported in appropriate timing such that the recording medium is aligned with the four-color composite toner image on the intermediate transfer belt 6*a*. After the toner image is transferred, the surface of the intermediate transfer belt 6*a* is cleaned by the cleaning device 6*h* in preparation for the subsequent imaging cycle.

In the developing device 5, the developer is transferred from the conveyance screw 5*c* to the developing roller 5*a* by the magnetic pole, not shown, of the developing roller 5*a*. Subsequently, the developer is transported to the vicinity of the developing blade 5*b* by a frictional force of the surface of the developing roller 5*a* and the transfer magnetic field.

The developer transported to the vicinity of the developing blade 5*b* is temporarily accumulated upstream of the developing blade 5*b*. The thickness of a developer layer is regulated in the gap between the developing blade 5*b* and the developing roller 5*a*, and then the developer is transported to the developing region.

A predetermined developing bias is supplied to the developing region, thereby forming a developing electric field on the electrostatic latent image on the photoreceptor 2 in the direction of biasing the toner. Accordingly, the toner is developed on the photoreceptor 2.

The developer passing the developing region is separated from the developing roller 5*a* at a developer release position of the developing sleeve 5*a* and thus recovered to the conveyance screw 5*c*. Subsequently, the toner concentration of the developer is adjusted to an appropriate density at the toner supply portion, and the developer is transported to the developing roller 5*a* again.

A permeability sensor 5*d* (hereinafter referred to as T-sensor 5*d*) for detecting the toner concentration in the developer is provided substantially at the bottom of the housing of the developing device 5.

As illustrated in FIG. 2, the T-sensor 5*d* and the above-described optical sensor 17 are connected to an I/O unit 18 via an A/D modulator, not shown. A control unit includes the I/O unit 18, a CPU 19, a ROM 20, and a RAM 21. A control signal is transmitted to a drive motor 15 that drives the toner supply device via the I/O unit 18.

The RAM 21 includes a Vt register, a Vtref register, a Vs register, and so forth. The Vt register is configured to store temporarily an output value Vt of the T-sensor 5*d* read from the I/O unit 18. The Vtref register is configured to store a toner concentration control reference value Vtref in the developing device 5. The Vs register is configured to store an output value Vs from the optical sensor 17 provided in the vicinity of the intermediate transfer belt 6*a*.

The ROM 20 stores a toner concentration control program and a parameter correction program for the image density, for example.

Figure 3:
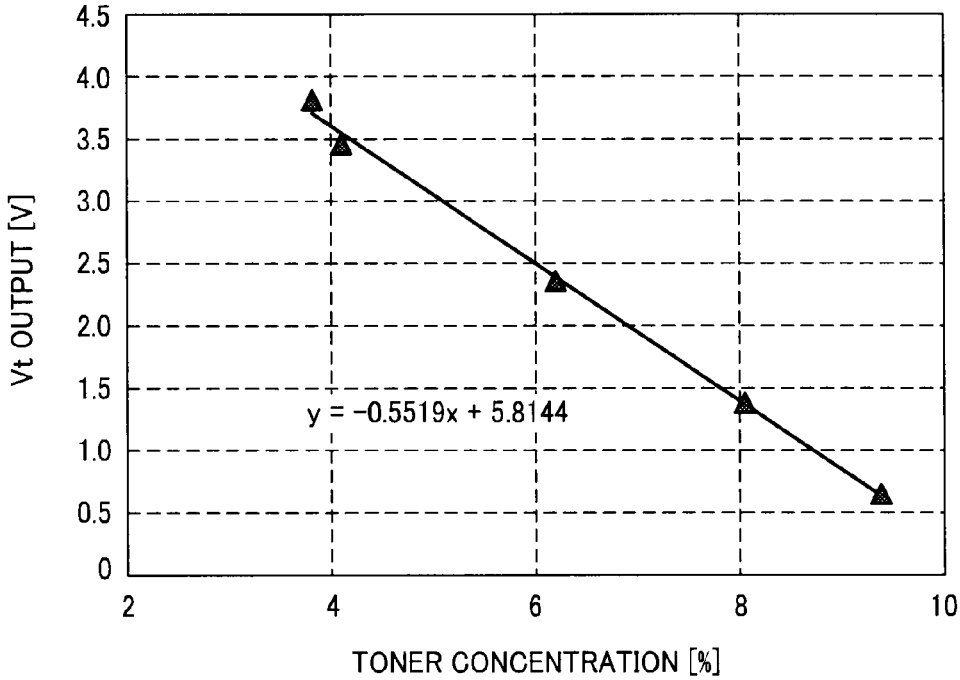
FIG. 3 is a graphic representation of a relation between an output of a toner sensor (T-sensor) and a toner concentration according to an exemplary embodiment of the present invention.

A description will be now provided of toner supply control performed for each printing operation. Referring now to FIG. 3, there is provided a graphic representation of a relation between the output of the T-sensor and the toner concentration. In FIG. 3, a vertical axis represents the output of the T-sensor and a horizontal axis represents the toner concentration.

As can be seen in FIG. 3, a straight-line approximation can be obtained within a certain toner concentration. Further, as can be seen in FIG. 3, the higher the toner concentration the smaller the output value of the T-sensor 5*d*.

In FIG. 3, Vt represents the output value of the T-sensor 5*d* indicating a current toner concentration. Vtref represents the toner concentration control reference value. When Vt is greater than Vtref, in order to cancel out the difference between Vt and the Vtref, the motor of the toner supply device is driven to supply the toner.

By contrast, when Vt is smaller than Vtref, the motor of the toner supply device is halted so that the toner is not supplied.

Figure 4:
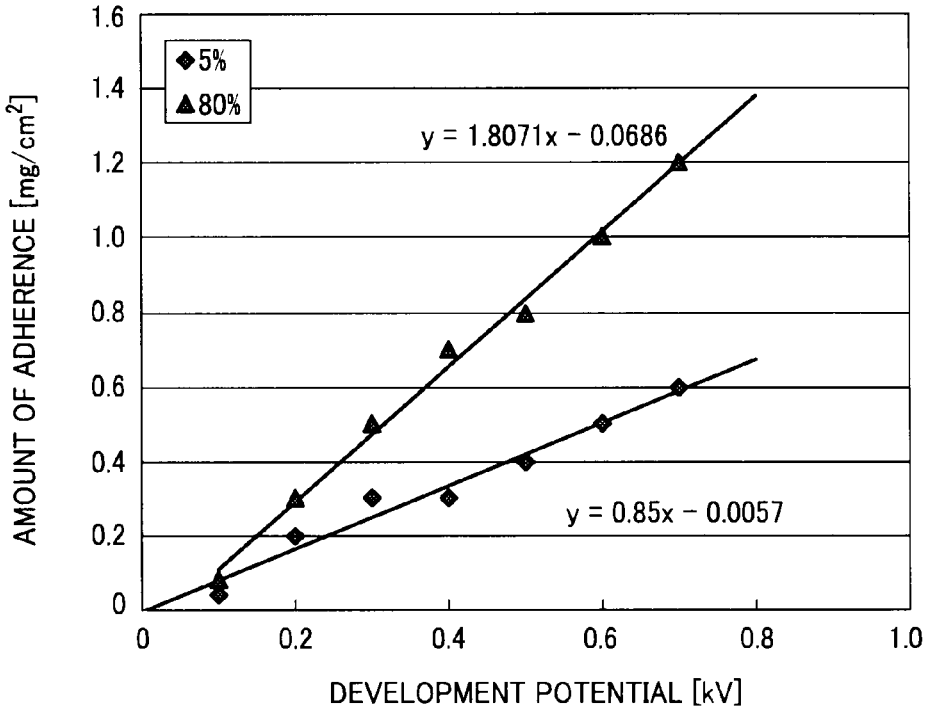
FIG. 4 is a graphic representation of a development potential and an amount of toner adherence according to an exemplary embodiment of the present invention.

Referring now to FIG. 4, there is provided a graphic representation of a relation between a development potential and toner adherence based on experiments. With reference to FIG. 4, a description is provided of a method for measuring and correcting the developability.

In FIG. 4, a difference in developability γ obtained by an area ratio of an output image is indicated. The developability γ herein refers to the slope of a formula relating amount of the toner adherence relative to developing potential.

In experiments, 100 sheets of images having the same image area ratio were continuously output at a normal linear velocity of approximately 120 mm/sec, and the developability γ was obtained.

As can be understood from FIG. 4, the developability γ rises when the amount of the toner replaced increases or the image area ratio is high in a certain period of time even if the toner concentration does not change. This indicates that physical adherence between the toner and the carrier or electrostatic adherence between the toner and the carrier changes.

Therefore, when the correction is performed, the difference in the developability γ due to fluctuation in the amount of the toner replaced in the certain period of time needs to be taken into account.

The developability γ was obtained by creating reference patterns for 10 gradations for measuring the toner concentration on the photoreceptor 2 while the development potential was changed. The reference patterns were created sequentially from the lower development potential while the potential of the writing unit was fixed, and the developing bias and the charging bias were varied.

Subsequently, the toner developed on the photoreceptor 2 was transferred onto the intermediate transfer belt. The reference patterns transferred onto the intermediate transfer belt were detected by a photosensor provided downstream of the intermediate transfer belt in the direction of its rotation. The photosensor measured the reflected light from the reference patterns.

Subsequently, the reflected light from the reference patterns was converted to the amount of toner adherence [mg/cm$^2$]. A relational formula or equation was then obtained by approximating the amount of the toner adhered [mg/cm$^2$] and the development potential [kV] by a straight line. Accordingly, the developability γ [mg/cm$^2$/kV] is indicated by the slope of that relational equation.

It is to be noted that, based on the above-described relational equation, the development potential for obtaining a target toner adherence amount can be calculated. According to the exemplary embodiment, the reference patterns are created for 10 gradations in each of the image forming units 1.

Alternatively, the reference patterns may be created for less than 10 gradations. The approximation by a straight line can be obtained when the reference patterns are created for three gradations or more. However, it is desirable to create the reference patters for four gradations or more in order to reduce error.

In view of the above, the present inventors have found that it is effective to regulate the toner concentration to stabilize the developer. In other words, in principle, the toner concentration control reference value is changed such that a certain developability γ is maintained consistently, that is, the amount of charge on the toner is consistent.

The toner replaced in a certain period of time can be expressed, for example, as an image area [cm$^2$] and an image area ratio [%]. However, for simplicity and understandability, the image area ratio [%] is used herein.

When using the image area ratio [%] to express the amount of the toner replaced in a certain period of time, a unit [mg/page] is employed, and correction is performed accordingly. For example, when the size of the recording sheet is A4 and a solid image of 100% is output thereon, that is, the image area ratio is 100%, approximately 300 mg of the toner is consumed, thus supplying approximately 300 mg of toner. The amount of the toner replaced is expressed as 300 [mg/page].

However, in order to convert the image area ratio [%] to the amount of the toner replaced, a normal recording sheet is set to a horizontal A4-size sheet, and the recording sheets in different sizes are converted to the horizontal A4 size sheet and the image area ratio [%] is obtained accordingly. Thus, for example, an A3-size recording sheet is equivalent to two horizontal A4-size sheets.

In order to convert the image area [cm$^2$] to the amount of toner replaced, the image area [cm$^2$] of images that have been formed while the developing roller operated for a certain period of time can be totaled, for example.

Further, based on a cumulative number of rotations of the toner supply motor, the amount of toner replaced in the developer in a certain time frame can be obtained. It is to be noted that an amount of the developer in the developing unit used in the experiments performed by the present inventors was approximately 225 g.

Figure 5:
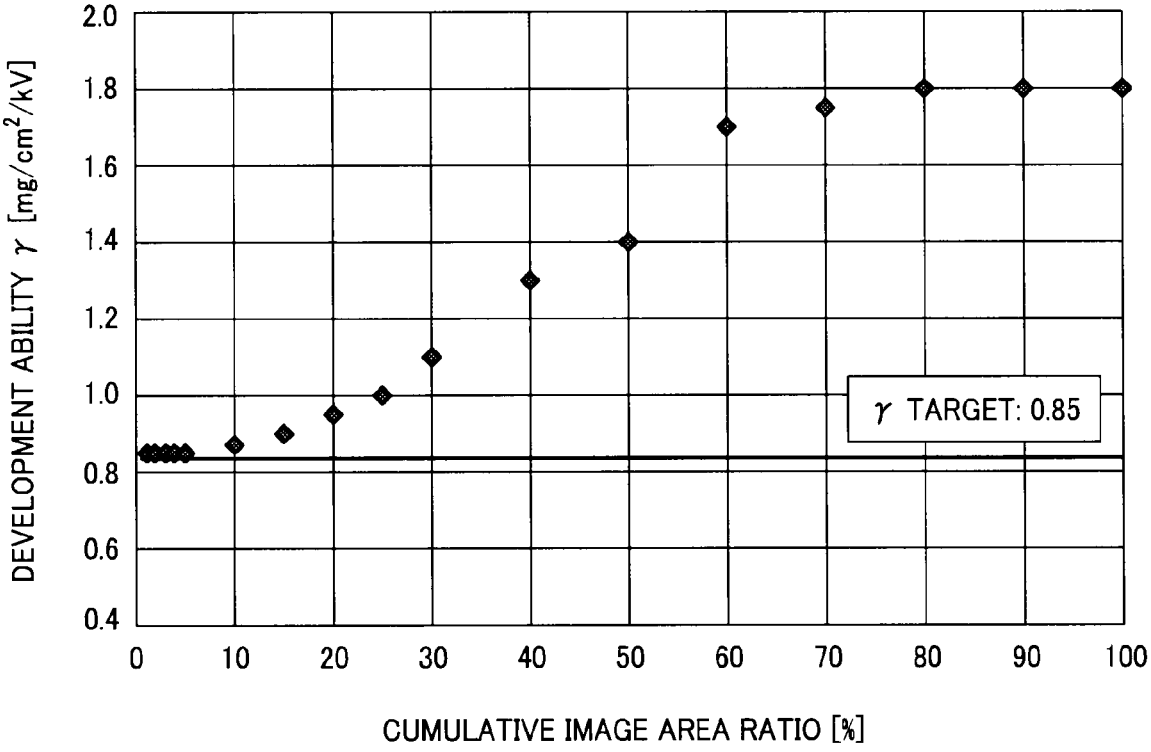
FIG. 5 is a graphic representation of a cumulative image area ratio and developability according to an exemplary embodiment of the present invention.

Referring now to FIG. 5, there is provided a graphic representation of a relation between the image area ratio [%] and the developability γ (mg/cm$^2$/kV) based on the experiments. In FIG. 5, the horizontal axis represents the image area ratio (%) and the vertical axis represents the developability γ (mg/cm$^2$/kV).

In the experiments, similar to the experiments described above, the developability γ was obtained while 100 sheets of images having the same image area ratio were continuously output at a normal linear velocity of approximately 120 mm/sec, and the same toner concentration was maintained.

As can be understood from FIG. 5, when the image area ratio is greater than a reference value of 5%, the developability γ tends to increase. Thus, when the image area ratio is greater than 5%, it is necessary to reduce the toner concentration to a relatively low level by increasing the control reference value Vtref for the toner concentration.

By contrast, when the image area ratio is less than 5%, the developability γ tends to be low. Thus, it is necessary to increase the toner concentration to a relatively high level by reducing the control reference value Vtref for the toner concentration.

Figure 6A:
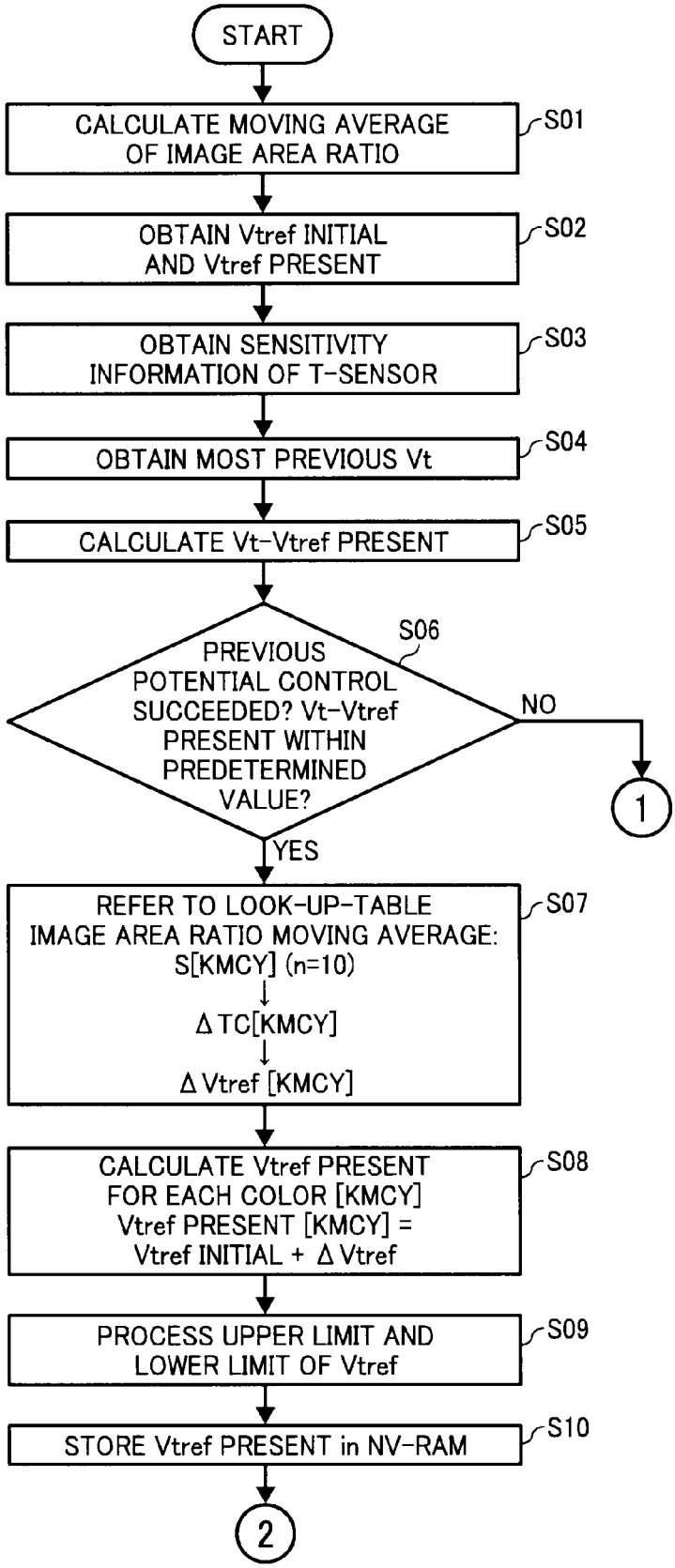
FIGS. 6A and 6B are flowcharts showing an image density control procedure according to an exemplary embodiment of the present invention.
Figure 6B:
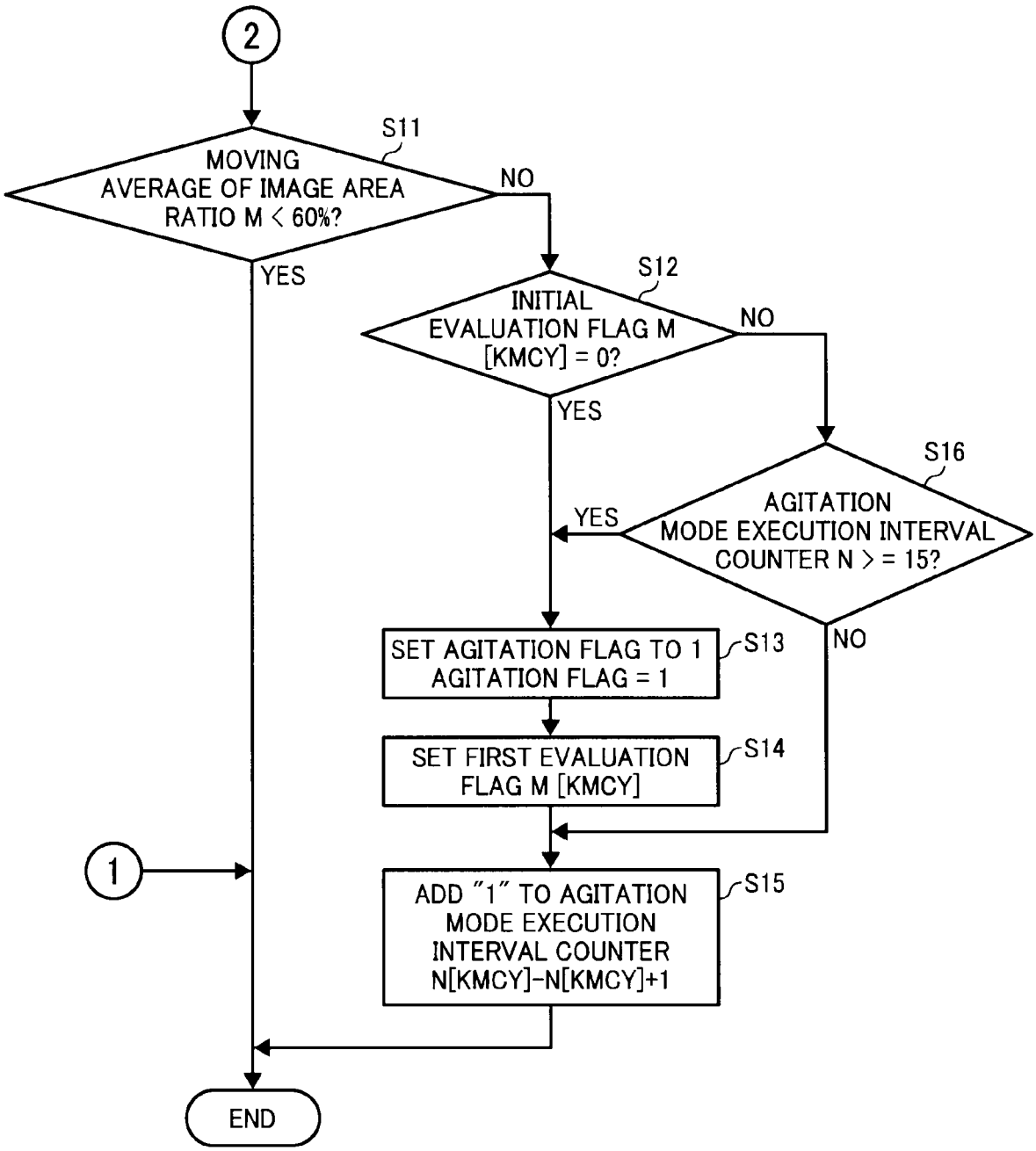

Referring now to FIG. 6, there is provided a flowchart illustrating a toner concentration correction procedure. The correction according to the exemplary embodiment is performed after each print job.

At step S01, an average of the image area ratios [%] of output images is obtained. The image area ratio [%] is calculated for each sheet when calculating the average of the image area ratios [%].

When performing the correction, the image area ratio [%] can be an overall average of the image area ratios from a certain point in time. For example, the overall average may be calculated from the time when the potential is controlled. More preferably, the correction is performed using a moving average.

When using the moving average, it is possible to understand the history of toner replacement performed for a few sheets to several tens of sheets so that the characteristics of the developer can be recognized.

The moving average can simply be the average of the image area ratios of a few past recording sheets. However, according to the exemplary embodiment, for simplicity, the image area ratio is calculated in accordance with the following equation:

$$M(i)=(1/N)\{M(i-1)\times(N-1)+X(i)\} \quad (1)$$

M(i) is a current moving average of the image area ratios. M(i−1) is a previous moving average of the image area ratios. N is a cumulative sheet number. X(i) is a current image area ratio (%). It is to be noted that M(i) and X(i) are obtained for each color. When such an equation is used, it is not necessary to store the image area ratios for a few sheets to several tens sheets in an NV-RAM, thereby simplifying operation.

According to the exemplary embodiment, when the current moving average is obtained using the moving average of the image area ratios from the past to the previous one, it is possible to reduce significantly the area used in the NV-RAM.

Further, the control response can be changed by changing the cumulative sheet number. For example, it is possible to regulate the toner concentration effectively by changing the number of cumulative sheets upon fluctuation in ambient conditions or after a certain time.

Subsequently, at step S02, the current value of Vtref (Vtref Present) and the initial value of Vtref (Vtref Initial) are obtained independently for each color [KMCY]. The initial value of Vtref and the current value of Vtref are related as follows:

$$Vtref\ \text{Present}=Vtref\ \text{Initial}+\Delta Vtref \quad (2)$$

ΔVtref is a correction amount of Vtref calculated based on an LUT (Look Up Table), and is obtained from an equation (3) described below. A detailed description thereof will be provided later.

Subsequently, at step S03, sensitivity information for the T-sensor 5*d* is obtained. The unit of sensitivity of the T-sensor 5*d* is V/wt %, and the value thereof is intrinsic to the sensor. An absolute value of the slope of the straight line plotted in FIG. 3 indicates the sensitivity thereof.

Subsequently, at step S04, the immediately preceding output value Vt of the T-sensor 5*d* is obtained. Then, at step S05, Vt−Vtref Current is calculated. Then, at step S06, whether or not correction needs to be performed is determined.

A determination as to whether or not the correction needs to be performed may be made by determining whether or not the previous potential control succeeded or not, or whether or not the Vt−Vtref Current is within a predetermined value, that is, whether or not the toner concentration control has been properly performed. At step S06, when it is determined that no correction is performed, the procedure is finished.

By contrast, when it is determined that the correction is performed at step S06, the LUT is referenced at step S07. Table 1 shows an example of the LUT.

TABLE 1

LUT

| IMAGE AREA MOVING AVERAGE (%) | ΔTC [WT %] | (When T-sensor sensitivity is 0.3) ΔVtref = (−1) × ΔTC × SENSITIVITY OF T-SENSOR (SP) [V] |
|---|---|---|
| Mi < 1 | 0.5 | −0.15 |
| 1 ≦ Mi < 2 | 0.4 | −0.12 |
| 2 ≦ Mi < 3 | 0.3 | −0.09 |
| 3 ≦ Mi < 4 | 0.2 | −0.06 |
| 4 ≦ Mi < 6 | 0 | 0.00 |
| 6 ≦ Mi < 7 | −0.1 | 0.03 |
| 7 ≦ Mi < 8 | −0.2 | 0.06 |
| 8 ≦ Mi < 9 | −0.3 | 0.09 |
| 9 ≦ Mi < 10 | −0.4 | 0.12 |
| 10 ≦ Mi < 20 | −0.5 | 0.15 |
| 20 ≦ Mi < 30 | −0.6 | 0.18 |
| 30 ≦ Mi < 40 | −0.7 | 0.21 |
| 40 ≦ Mi < 50 | −0.8 | 0.24 |
| 50 ≦ Mi < 60 | −0.9 | 0.27 |
| 60 ≦ Mi < 70 | −1.0 | 0.30 |
| 70 ≦ Mi < 80 | −1.0 | 0.30 |
| 80 ≦ Mi | −1.0 | 0.30 |

First, according to the moving average of the image area ratios, a ΔTC to be changed, or an amount by which the toner concentration is changed, is determined. After ΔTC is determined, ΔVtref is calculated using the sensitivity of the T-sensor obtained at step S03. Accordingly, ΔVtref is obtained and stored in the NV-RAM using the following equation:

$$\Delta Vtref=(-1)\times\Delta TC\times\text{Sensitivity of } T\text{-sensor} \quad (3)$$

It is to be noted that ΔVtref is calculated for each color, black, magenta, cyan, and yellow [KMCY]. The LUT employed in the exemplary embodiment is created using the following method.

Figure 7:
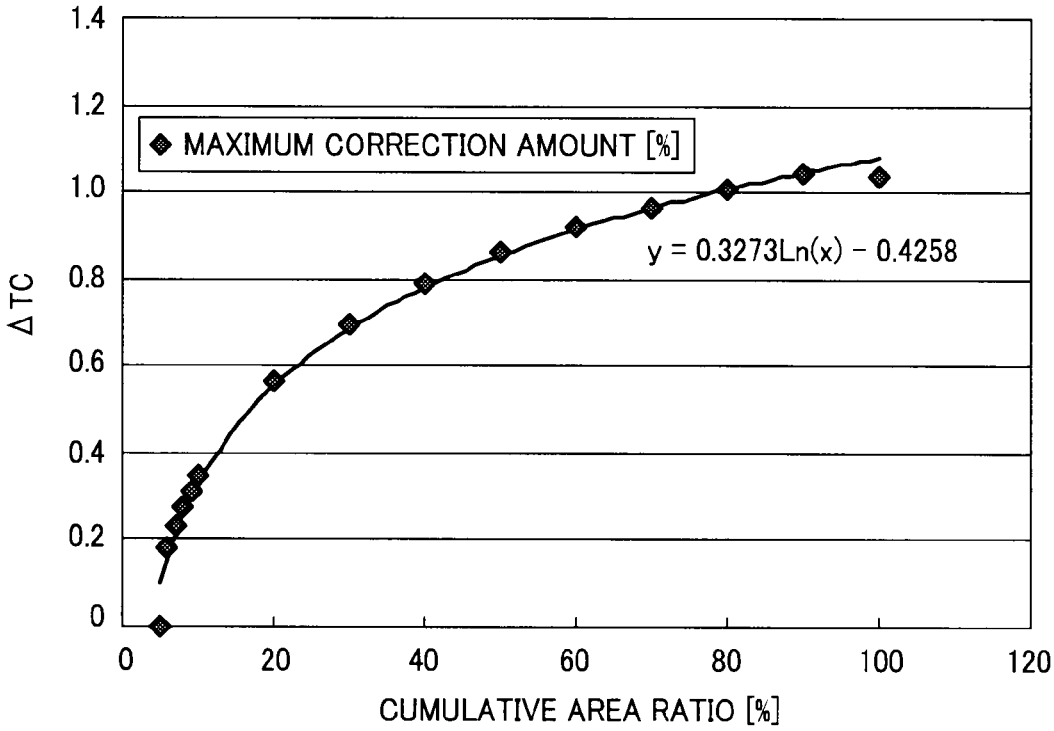
FIG. 7 is a graphic representation of a relation of the cumulative image area ratio and a degree to which a toner concentration is changed according to an exemplary embodiment of the present invention.

Referring now to FIG. 7, there is provided a graphic representation of a relation of the image area ratio (%) and an amount (wt %) by which the toner concentration is changed. FIG. 7 illustrates an amount (wt %) of ΔTC by which the toner concentration is changed so as to be able to maintain consistently the developability γ relative to a certain reference toner concentration TC.

For example, in a case in which the image area ratio is approximately 80%, when an image is output while ΔTC is 1 [wt %], the developability γ can be maintained consistently.

Logarithmic approximation is used to approximate accurately the correction amount of ΔTC relative to the image area ratio, and is so used. For this reason, in the exemplary embodiment, the amount of ΔTC relative to the image area ratio used in the LUT is determined using the logarithmic approximation method.

According to the exemplary embodiment, when the image area ratio is less than 10%, the correction is configured to be performed at intervals of 1% of the image area ratio, for example. When the image area ratio is 10% or greater, the correction is performed at intervals of 10%. The correction intervals can be changed as necessary depending on the characteristics of the developer and the developing device employed. Alternatively, a more detailed table can be employed.

Adjustment of a maximum amount of correction for each color can be performed using the following equation, for example:

$$\Delta Vtref=(-1)\times\Delta TC\times\text{Sensitivity of } T\text{-sensor}\times\text{Color Correction Factor} \quad (4)$$

When ambient conditions or time needs to be taken into account, Equation 4 can be multiplied by an ambient condition correction factor or a time correction factor so that correction can be performed more accurately.

According to the exemplary embodiment, the correction is performed by using the LUT. Alternatively, the approximation as shown in FIG. 7 may be used to calculate for each time.

After ΔVtref is calculated at step S07, the current value of Vtref is calculated at step S08. Vtref is calculated in accordance with Equation 2 using the current Vtref (Vtref Current) and the initial Vtref (Vtref Initial) obtained at step S02 using equation (2):

$$Vtref\ \text{Current} = Vtref\ \text{Initial} + \Delta Vtref$$

It is to be noted that Vtref Current is calculated individually for each color, black, magenta, cyan, and yellow [KMCY].

Next, at step S09, an upper limit and a lower limit of Vtref are processed such that when Vtref Current after correction is equal to or greater than a preset Vtref upper limit, Vtref Current after correction is set to the preset Vtref upper limit.

By contrast, when Vtref Current after correction is equal to or less than the lower limit, Vtref Current after correction is set to the preset Vtref lower limit. Subsequently, Vtref Current is stored in the NV-RAM at step S10.

The foregoing description pertains to a basic correction procedure according to the exemplary embodiment. According to the exemplary embodiment, when the moving average of the image area ratios is greater than a threshold value, operation modes are switched so that image forming intervals can be changed.

In particular, according to the exemplary embodiment, the image forming intervals are changed by inserting a developer agitation mode after a few sheets or several tens of sheets are printed.

A description will now be provided of the developer agitation mode according to the exemplary embodiment of the present invention. In the developer agitation mode according to the exemplary embodiment, the devices associated with image forming operation remain operable, but writing operation is not performed.

Figure 8:
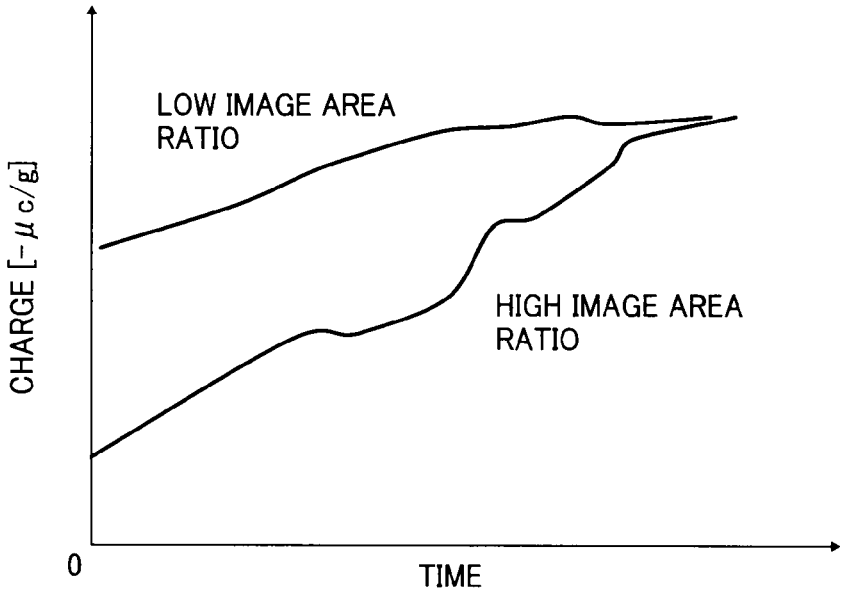
FIG. 8 is a graphic representation of a difference in a charging amount between a low-image area ratio and a high-image area ratio.

First, with reference to FIG. 8, a description will be provided of a difference in electric charge between a low image area ratio and a high image area ratio.

As can be seen in FIG. 8, a saturation time for the charge amount of the toner to saturate is different before the toner is supplied, when the image area ratio is relatively high and a significant amount of toner is replaced. In FIG. 8, 0 in the horizontal axis refers to a time when a new toner is supplied.

When the image area ratio is relatively low, the degree to which the toner concentration decreases is relatively small when the new toner is supplied. Thus, the toner can be charged in a relatively short period of time.

By contrast, when the image area ratio is relatively high, the amount of the toner replaced is large. Thus, the degree to which the toner charge amount drops when the new toner is supplied is most likely large, thereby requiring longer toner charging time.

In order to reduce, if not prevent entirely, this difference in the charge amount from arising, the developer agitation mode (hereinafter simply referred to as the agitation mode) is inserted. When executing the agitation mode, the toner is dispersed, facilitating toner contact with the carrier and thereby making it possible to charge the toner.

As described above, in the related art, the developability γ is calculated so as to change the image forming bias while the image area ratio is high. In other words, the developability γ is calculated while the toner charge amount is unstable, thereby causing unstable control of the toner concentration.

Referring back to FIG. 6, a description will now be provided of a toner concentration control procedure of the present embodiment when the image area ratio is relatively high.

At step S11, it is determined whether or not the moving average of the image area ratios is greater than a predetermined image area ratio. According to the exemplary embodiment, the predetermined image area ratio is approximately 60%, for example.

The moving average of the image area ratios used at step S11 is independent of step S01, thereby making it possible to adjust independently Vtref correction and the frequency of the developer agitation mode at step S13.

At step S11, when the moving average of the image area ratios is equal to or less than the predetermined image area ratio (YES, step S12), the procedure is finished.

On the other hand, when it is determined that the moving average of the image area ratios is greater than the predetermined image area ratio, that is, 60% according to the exemplary embodiment (NO, step S11), processing proceeds to step S12.

At step S12, whether or not an initial evaluation flag M [KMCY] is set is verified. When the initial evaluation flag is not set, that is, when M=0, (YES, step S12), this means that this is the first agitation mode after the condition of step S11 is satisfied.

Subsequently, at step S13, the agitation flag is set to 1 (AGITATION FLAG=1) so that the agitation mode is executable. Then, at step S14, the first evaluation flag M [KMCY] is set. At step S15, "1" is added to a counter N [KMCY] that shows the number of agitation mode execution intervals, and the procedure is finished.

When the initial evaluation flag M [KMCY] is set at step S12 (NO at step S12), processing proceeds to step S16 and the counter N [KMCY] is confirmed. At step S16, when the counter N [KMCY] is equal to or less than the predetermined value, for example, "15" (NO at step S16), according to the exemplary embodiment, processing proceeds to step S15 at which "1" is added to the counter N [KMCY], and the procedure is finished.

When, on the other hand, the counter N [KMCY] is equal to or greater than the predetermined value, for example, "15" (YES at step S16), according to the exemplary embodiment, this means that there is a sufficient interval in which the next agitation mode can be executed after the previous agitation mode. Therefore, at step S13, the agitation flag is set to 1 (AGITATION FLAG=1) so that the agitation mode is executable.

Subsequently, at step S14, the initial evaluation flag M [KMCY] is set. At step S15, "1" is added to the counter N [KMCY], and the procedure is finished. It is to be noted that the counter N is reset when the agitation mode is executed.

According to the exemplary embodiment, the image forming intervals are changed by inserting the developer agitation mode into the print job. Alternatively, a distance between sheet positions may be changed, or an image-forming line speed may be changed to change the image forming intervals.

Changing the image forming intervals as described above also makes it possible to disperse the toner evenly so as to enhance contact between the toner and the carrier. Thus, a similar if not the same effect as that of the exemplary embodiment can be achieved.

Running experiments, described below, were performed to evaluate the toner concentration control of the exemplary embodiment under the following conditions in order to compare the time required to adjust the image forming bias.

Comparative Example 1

Process control including control of image forming bias conditions is inserted at every 30 sheets.

Comparative Example 2

The agitation mode of four seconds is inserted at every 20 sheets.

Exemplary Embodiment

The toner concentration control reference value is changed in accordance with the moving average of the image area ratios. The agitation mode of four seconds is inserted at every 20 sheets.

Printing Conditions

A 100%-solid image was printed continuously on 100 A4-horizontal sheets.

The image forming apparatus used for the experiments was Imagio MPC 2500: CPM, capable of printing 25 sheets per minute.

With reference to Table 2, results of the experiments were compared.

TABLE 2

| | ADJUSTMENT TIME REQUIRED FOR ONE OPERATION (SECOND) | NUMBER OF ADJUSTMENT | TOTAL TIME (SECOND) |
|---|---|---|---|
| COMPARATIVE EXAMPLE 1 | 10 | 3 | 30 |
| COMPARATIVE EXAMPLE 2 | 4 | 4 | 16 |
| EXEMPLARY EMBODIMENT | 4 | 4 | 16 |

As can be seen in Table 2, adjustment of the image forming bias for the toner patches took 10 seconds according to COMPARATIVE EXAMPLE 1, and the total adjustment time was 30 seconds, which was the longest among three examples.

By contrast, according to COMPARATIVE EXAMPLE 2 and the exemplary embodiment, the agitation mode of four seconds was inserted at every 20 sheets. Accordingly, the total adjustment time was no more than 16 seconds, thereby reducing downtime compared to COMPARATIVE EXAMPLE 1.

Figure 9:
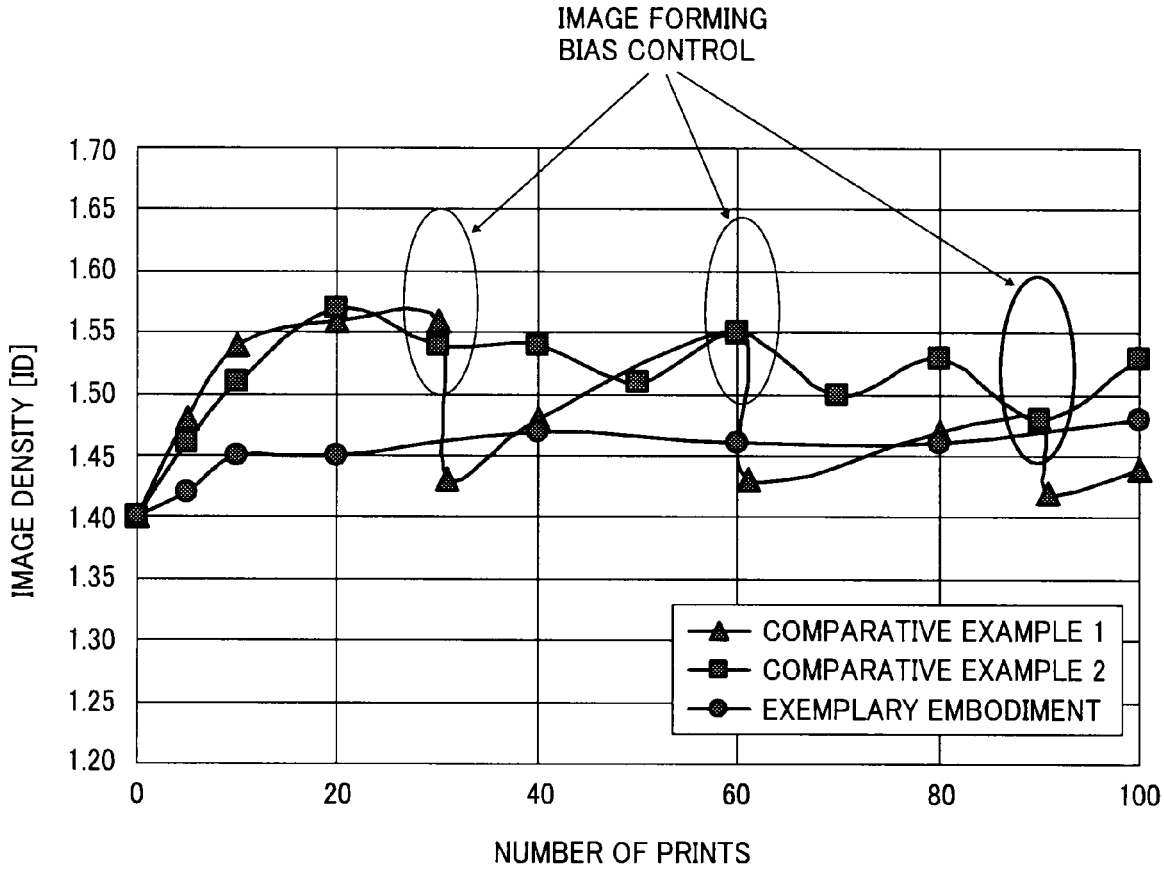
FIG. 9 is a graphic representation of a comparison of fluctuation in image density between a comparative example 1, a comparative example 2, and the exemplary embodiment of the present invention.

Next, a description will be given of comparisons of consistency of the image density between COMPARATIVE EXAMPLE 1, COMPARATIVE EXAMPLE 2, and the exemplary embodiment. Referring to FIG. 9, there is provided a graphic representation of fluctuation in image density according to COMPARATIVE EXAMPLE 1, COMPARATIVE EXAMPLE 2, and the exemplary embodiment.

As can be seen from FIG. 9, the image density fluctuated widely before and after the image forming bias was controlled according to COMPARATIVE EXAMPLE 1. According to COMPARATIVE EXAMPLE 2, the image density rose before the agitation mode was inserted. Further, the image density did not adequately recover in the agitation mode in COMPARATIVE EXAMPLE 2.

By contrast, according to the exemplary embodiment, the degree to which the image density increased before the agitation mode was inserted was relatively small. Further, fluctuation in image density was relatively moderate before and after the agitation mode, and image density remained relatively consistent throughout the experiment.

As can be seen in COMPARATIVE EXAMPLE 2, when the agitation mode was simply inserted without changing the toner concentration control reference value in accordance with the moving average of the image area ratios, the image density increased. This is because the agitation time is not adequate, making it difficult to reduce downtime. Thus, it is necessary to extend each agitation time, or the frequency implementation of the agitation mode.

By contrast, according to the exemplary embodiment, downtime can be reduced and imaging quality can be enhanced by employing a combination of changing the reference control value for the toner concentration based on the image area ratio and inserting the agitation mode.

It is to be noted that elements and/or features of different exemplary embodiments may be combined with each other and/or substituted for each other within the scope of this disclosure and appended claims.

Moreover, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. An image density control method for controlling image density in an image forming apparatus, the image forming apparatus, comprising:

an image bearing member configured to bear an electrostatic latent image on a surface thereof;

a developing device configured to develop the electrostatic latent image formed on the image bearing member using a two-component developer including a toner and a carrier to form a toner image;

a toner supply device configured to supply the toner to the developing device; and a toner concentration controller configured to maintain a toner concentration in the developing device at a certain density; and a transfer device configured to transfer the toner image on the image bearing member, the image density control method comprising:

adjusting a toner concentration control reference value in accordance with an amount of the toner replaced in the developing device so as to adjust the image density to maintain a consistent developability; and changing image forming intervals, by changing a timing of inserting a developer agitation mode after an image forming interval, in accordance with an amount of the toner replaced in the developing device during continuous printing operation.

2. The image density control method according to claim 1, further comprising using a moving average obtained from image area ratios as the amount of the toner replaced in the developing device.

3. The image density control method according to claim 1, further comprising executing the agitation mode in which the developer is agitated during the continuous printing operation, wherein the changing of the image forming intervals is performed during execution of the agitation mode.

4. The image density control method according to claim 3, wherein the agitation mode is executed when the moving average of the image area ratios is equal to or greater than a predetermined threshold.

5. An image forming apparatus for forming an image, comprising:

an image bearing member configured to bear an electrostatic latent image on a surface thereof;

a developing device configured to develop the electrostatic latent image formed on the image bearing member using a two-component developer including a toner and a carrier to form a toner image;

a toner supply device configured to supply the toner to the developing device;

a toner concentration controller configured to maintain a toner concentration in the developing device at a certain density; and a transfer device configured to transfer the toner image on the image bearing member, wherein the toner concentration controller adjusts a toner concentration control reference value in accordance with an amount of the toner replaced in the developing device so as to adjust the image density to maintain a consistent developability, and changes image forming intervals during continuous printing operation in accordance with an amount of the toner replaced in the developing device, by changing a timing of inserting a developer agitation mode after an image forming interval.

6. The image forming apparatus according to claim 5, wherein the toner concentration controller uses a moving average obtained from image area ratios as the amount of the toner replaced in the developing device.

7. The image forming apparatus according to claim 5, wherein the toner concentration controller changes the image forming intervals during the continuous printing operation by executing the agitation mode during the continuous printing operation.

8. The image forming apparatus according to claim 7, wherein the toner concentration controller executes the agitation mode when the moving average of the image area ratios is equal to or greater than a predetermined threshold.

* * * * *